US010414199B2

(12) United States Patent
Isserstedt

(10) Patent No.: US 10,414,199 B2
(45) Date of Patent: Sep. 17, 2019

(54) STORAGE DEVICE WITH LABEL TAG

(71) Applicant: Robert Isserstedt, Salzburg (AT)

(72) Inventor: Robert Isserstedt, Salzburg (AT)

( * ) Notice: Subject to any disclaimer, the term of this patent is extended or adjusted under 35 U.S.C. 154(b) by 0 days.

(21) Appl. No.: 15/557,615

(22) PCT Filed: Mar. 10, 2016

(86) PCT No.: PCT/EP2016/055158
§ 371 (c)(1),
(2) Date: Sep. 12, 2017

(87) PCT Pub. No.: WO2016/142476
PCT Pub. Date: Sep. 15, 2016

(65) Prior Publication Data

US 2018/0056704 A1 Mar. 1, 2018

(30) Foreign Application Priority Data

Mar. 12, 2015 (GB) ..... 1504197.3

(51) Int. Cl.
*B42F 21/02* (2006.01)
*B42F 7/02* (2006.01)

(52) U.S. Cl.
CPC ..... *B42F 21/02* (2013.01); *B42F 7/02* (2013.01); *B42P 2241/02* (2013.01)

(58) Field of Classification Search
CPC .... B42F 21/02; B42F 7/02; B42F 7/06; B42P 2241/02
(Continued)

(56) References Cited

U.S. PATENT DOCUMENTS 1,732,541 A 10/1929 Sacerdote
2,289,577 A 7/1942 Jonas
(Continued)

FOREIGN PATENT DOCUMENTS

CA 2479524 A1 * 4/2006 ..... A47G 1/06
CN 201040452 Y 3/2008
(Continued)

OTHER PUBLICATIONS

Notification of Transmittal (Form PCT/ISA/220), International Search Report (Form PCT/ISA/210), and Written Opinion (Form PCT/ISA/237) for International Patent Application No. PCT/EP2016/055158 dated Jun. 2, 2016, 13 pages.
(Continued)

*Primary Examiner* — Christopher R Demeree
(74) *Attorney, Agent, or Firm* — Withrow & Terranova, P.L.L.C.; Vincent K. Gustafson

(57) ABSTRACT

A storage device having a first member and a second member between which is a storage space. Adjacent the top of the first member there is an upwardly projecting integral portion of the first member which forms a first element of a label tag. The first element of the label tag is provided with an open window. Behind the window is a separate cover sheet, which is secured to the first element of the label tag so that a label can be inserted and retained behind the window. The cover sheet provides a writing surface facing the window and in the absence of a label this can be written by means of a writing implement which extends through the window. The writing surface may act as a whiteboard and may have enhanced dry erase performance, for example by having a glossy finish.

11 Claims, 3 Drawing Sheets

(58) Field of Classification Search
USPC ..... 229/67.1, 67.2; 206/425; 40/359, 661
See application file for complete search history.

(56) References Cited

U.S. PATENT DOCUMENTS

| | | | | |
|---|---|---|---|---|
| 5,163,606 | A * | 11/1992 | Isserstedt | A45C 7/0059 229/67.2 |
| 5,620,133 | A | 4/1997 | Isserstedt | |
| 6,968,949 | B2 * | 11/2005 | Zivic | A45C 13/00 206/425 |
| 2004/0262185 | A1 * | 12/2004 | Mills | B42F 7/06 206/483 |
| 2009/0284002 | A1 * | 11/2009 | Miranti | B42F 7/06 281/22 |
| 2010/0300911 | A1 * | 12/2010 | Yamada | B42F 7/06 206/425 |

FOREIGN PATENT DOCUMENTS

| | | | |
|---|---|---|---|
| CN | 201128303 | Y | 10/2008 |
| FR | 2380891 | A1 | 9/1978 |

OTHER PUBLICATIONS

Search Report under Section 17(5) for United Kingdom Patent Application No. GB1504197.3 dated Feb. 8, 2016 (3 pages).

* cited by examiner

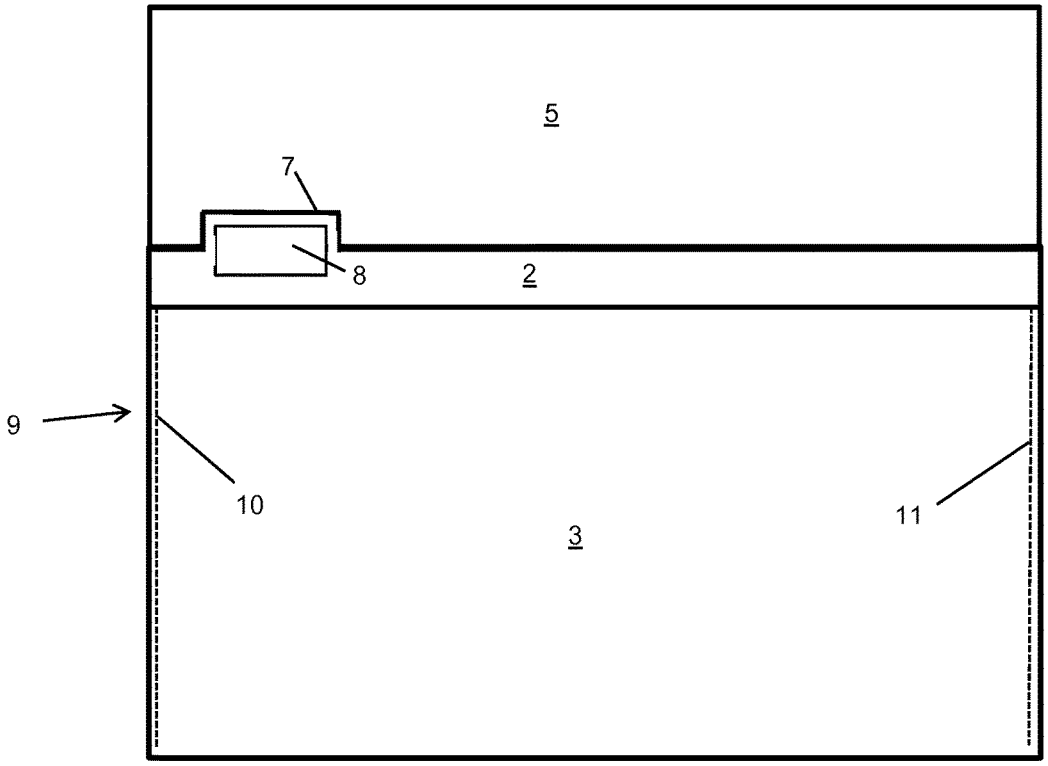
Figure 2
Figure 3
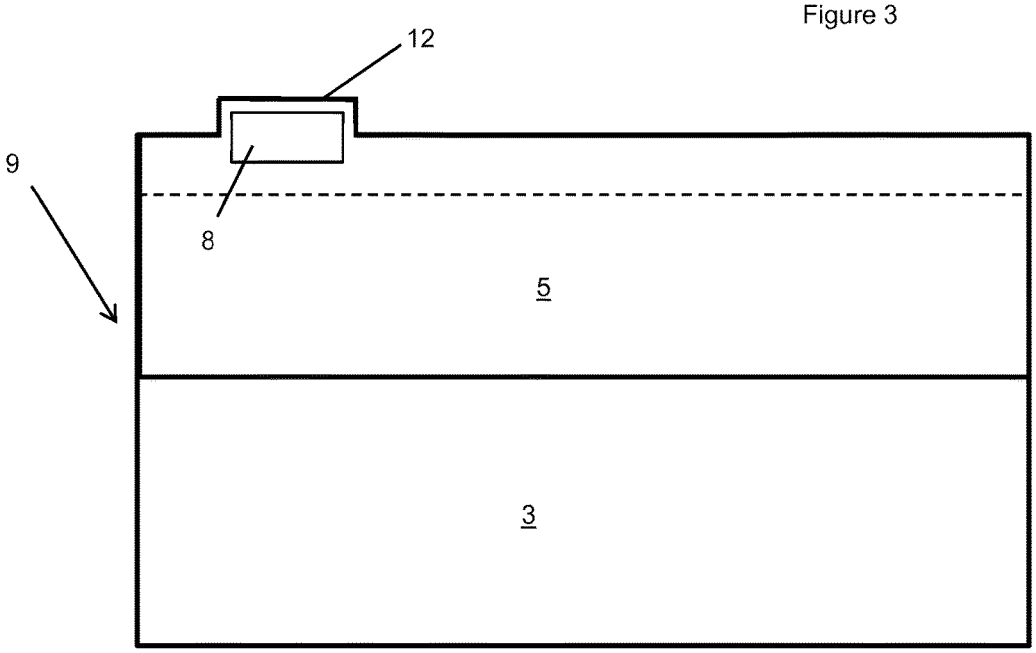

STORAGE DEVICE WITH LABEL TAG

STATEMENT OF RELATED APPLICATIONS

This application is a 35 U.S.C. § 371 national phase filing of International Application No. PCT/EP2016/055158 filed on Mar. 10, 2016, and further claims priority to United Kingdom Patent Application No. 1504197.3 filed on Mar. 12, 2015, with the contents of the foregoing applications hereby being incorporated by reference herein in their respective entireties.

This invention relates to a storage device with a label tag. The invention is particularly concerned with the provision of labels on storage devices such as files, pouches, wallets or folders to be mounted in or on filing arrangements, or to be used individually. Such filing arrangements could be, for example, in the form of a drawer of a filing cabinet for hanging files which are arranged in a horizontal array, or in the form of an arrangement such as that disclosed in U.S. Pat. No. 5,620,133 in which pouches can hang in an opened out array, e.g. vertically.

U.S. Pat. No. 1,732,541 discloses a storage device having a first member and a second member between which is provided a storage space, the storage device having a top and a bottom, wherein adjacent the top of the device, there is a label tag defined by an extension which is integral with the first member of the storage device. The extension is bent over so as to provide an upwardly extending rear element and a downwardly extending front element. The front element has a window cut into it. The end of the front element is attached to the first member so that the front and rear element of the label tag provide a pocket which can receive a label to be viewed through the window.

In CN201128303 there is disclosed a briefcase having a series of folders, each having a first member and a second member between which is provided a storage space, wherein adjacent the top of each folder, there is a tag head. In CN201128303 the tag head is defined by an extension which is integral with the first member of the folder. The extension is bent to form an upwardly extending rear element and downwardly extending front element. The front element has a window cut into it. The end of the front element is attached to the first member of the folder so that the front and rear element of the tag head provide a pocket which can receive a label to be viewed through the window. It is said that a label is inserted behind the window and a name can be written on the label, through the window. If the name needs to be changed, the label can be removed and a fresh one inserted, and the new name can be written on this through the window.

An object of the present invention is to provide label apparatus, in which labelling can be carried out in a number of different ways.

Viewed from one aspect, the present invention provides a storage device having a first member and a second member between which is provided a storage space, the storage device having a top and a bottom, wherein projecting from the top of the first member of the storage device there is a label tag defined by a front element and a rear element, the front element being provided with an open window; the front and rear elements defining a pocket which can receive a label to be viewed through the window; characterised in that the front element of the label tag comprises an upwardly projecting extension from the top of the first member of the storage device, which is integral with the first member of the storage device, and the rear element of the label tag is a piece of material which is separate from the first and second members of the storage device and is secured to the front element of the label tag behind the window, the rear element providing a whiteboard writing surface facing the window on which markings can be written by means of a writing implement which extends through the open window.

Because the rear element is a separate piece of material rather than being part of an extension of the first member of the storage device, as in the prior art, it can be chosen for its suitability as a whiteboard writing surface. Preferably, the writing surface is such as to assist in wet or dry-erase performance and the writing surface may be glossy or provided with a coating to assist in this aim. The writing surface may be provided by a plastics film, for example a film of polypropylene, which may have a glossy finish.

In some embodiments, the entire rear element of the label tag element facing the front element may be the whiteboard writing surface. Alternatively at least the visible portion of the rear element which can be seen through the window will be a whiteboard writing surface. Preferably the rear element is formed in its entirety by a plastics film, such as polypropylene.

In preferred embodiments, the material of the rear element differs from that of the first member and second member of the storage device. The material of the rear element could have a substrate, which could be the same as the material of the first and second members of the storage device, but is provided with a coating to provide the writing surface, so that overall the material of the rear element differs from that of the first member and second member of the storage device. Preferably the rear element is formed in its entirety of a material which, in terms of its physical characteristics and not just its colour, differs from that of the first member and second member of the storage device. Thus, the first and second members of the storage device may be of semi-rigid polypropylene, whilst the rear element of the label tag may be of flexible polypropylene film, preferably with a glossy finish.

A high gloss writing surface will assist in erase performance of the writing surface and will also provide reduced friction. As the front and rear elements of the label tag provide a pocket which can receive a label, if a user prefers not to write directly on the writing surface, low friction will ease insertion of, and removal of, the label. The label can be less stiff than may be necessary with other types of label holder which the label needs to be slid into.

The whiteboard writing surface will normally be of a contrasting colour to the colour of the first and second members of the storage device. However the writing surface does not need to be white, providing it contrasts with the colour of the first and second member of the storage device and is light enough for coloured or black or grey writing to be seen. Apart from white, colours such as cream or light yellow, or other light colours, can be used for the whiteboard surface.

In some embodiments the whiteboard surface is a glossy, usually white, surface for non-permanent markings.

Where in this specification the terms front and rear, or top and bottom, are used this refers to the orientation of the storage device when used with the first and second members of the storage device projecting upwardly and the storage device being viewed from a direction in which the writing surface is visible through the window of the label tag. The storage device could be stored or used in other orientations, for example with the first and second members of the storage device projecting horizontally.

In some embodiments, the open window in the front element of the label tag has a periphery with opposed first and second sides interconnected by opposed third and fourth sides; and the rear element of the label tag, which is secured to the first element behind the window, extends beyond the first and second sides of the window periphery and is secured to the front element at portions spaced from the first and second sides of the window periphery, the front element and the rear element thus defining opposed first and second channel portions extending respectively from adjacent the first and second sides of the window periphery; and at the third side of the window periphery, the rear element is not secured to the front element and the channel portions have open ends, so that a label member can be inserted behind the window between the front element and the rear element, and retained in the first and second channel portions.

The first, second, third and fourth sides of the window periphery could be straight. The first and second sides, could be parallel to each other. In some embodiments, the second and third sides could also be parallel to each other. In some embodiments, parallel second and third sides are perpendicular to parallel first and second sides. In such an arrangement, the perimeter of the window will be in the form of a rectangle and could be square or oblong. In some arrangements, the first and second sides could be straight and parallel, whereas the third and fourth sides could be of another configuration, such as curved. The curved sides could be convex, and in some embodiments they could be directed in opposite senses. In alternative embodiments the first and second sides could be non-parallel, and they could for example be curved and in some embodiments could be convex and in some embodiments could be directed in opposite senses. The window could, for example be oval, e.g. elliptical with major and minor axes of different lengths, or could be circular. In these cases there may be no clearly defined first, second, third and fourth sides and they can be defined by any suitable means. For example, a circular window could be divided into fourth equal portions of the circumference, defining the four sides. One, two, three or four of the sides could be of an irregular shape, for example for aesthetic reasons.

Whatever the shape of the window, in preferred embodiments the first and second channel portions are parallel and of at least approximately the same length. With a curved or irregular side of the perimeter of the window, the spacing of the point of attachment of the second element to the first element for the perimeter of the window, will alter.

At the fourth side of the window perimeter, in some embodiments the rear element of the label extends beyond the fourth side of the window periphery and is secured to the front element at portions spaced from the fourth side of the window periphery, the front element and the rear element thus defining a third channel portion. This can receive the end of a label member.

Securing of the rear element of the label tag to the front element of the label tag may be along one or more continuous lines or may be at a number of discrete points along a line. Securing of the rear element to the front element may be effected by adhesives, solvent welding, thermal bonding or any other suitable means. In some embodiments, both the front element and the rear element are of plastics materials, which may be the same or different. In some embodiments, only the rear element is of a plastics material. In some embodiments the front and rear elements may be flexible, and may be of flexible plastics material. In some embodiments, only the rear element is flexible, and may be of flexible plastics material.

The invention provides a multifunctional labelling arrangement. Text can be written on the writing surface of the rear element, through the open window. Alternatively, a label of e.g. plastics or card, which can be pre-printed, can be pushed into the label tag which then acts as a label holder. Alternatively, an adhesive label can be adhered to the visible part of the second element, through the open window. In this case, the window will serve to designate a suitable place for the label, and will help in aligning the label.

In accordance with the invention, the front element of the label tag comprises an upwardly projecting extension from the top of the first member of the storage device, which is integral with the first member of the storage device. In some embodiments, the window is provided partly in the upwardly extending extension and partly in an adjoining part of the first member of the storage device.

The first member may define either the front or the rear of the storage device, with the other of the front and rear being provided by the second member.

In some arrangements the storage device is in the form of a hanging file, having a portion adjacent the top of each side which is adapted to engage a file hanging rail. In some arrangements, the storage device is in the form of a device adapted to form part of an arrangement such as that disclosed in U.S. Pat. No. 5,620,133. In some embodiments the storage device is in the form of a stand-alone folder or wallet, which can be used singly or together.

The storage device may be at least partly of a flexible or semi-rigid material such as paper or plastics. In one embodiment, the storage device is in the form of a pouch of plastic material and is manufactured from a strip of material which is folded to provide front and rear members and a closure flap, the front and rear members being joined along their edges, the closure flap being defined by an extension form the top of rear member, and the front element of the label tag being defined at least partly by a cut line in the closure flap which defines a tab extending away from the top of the rear member. In one embodiment part of the first element is defined by part of the rear member and the window is defined partly in the tab and partly in that part of the rear member. In that embodiment the rear element of the label apparatus is attached to the back of the tab and the back of the part of the rear member.

In general, in some embodiments the first and second members of the storage device are of a material which is more rigid than the material of the rear element of the label tag.

Some embodiments of the invention will now be described by way of example and with reference to the accompanying drawings, in which:

FIG. 2 shows how the pouch is formed;

FIG. 3 shows the pouch with a flap closing the opening into the pouch:

Figure 1:
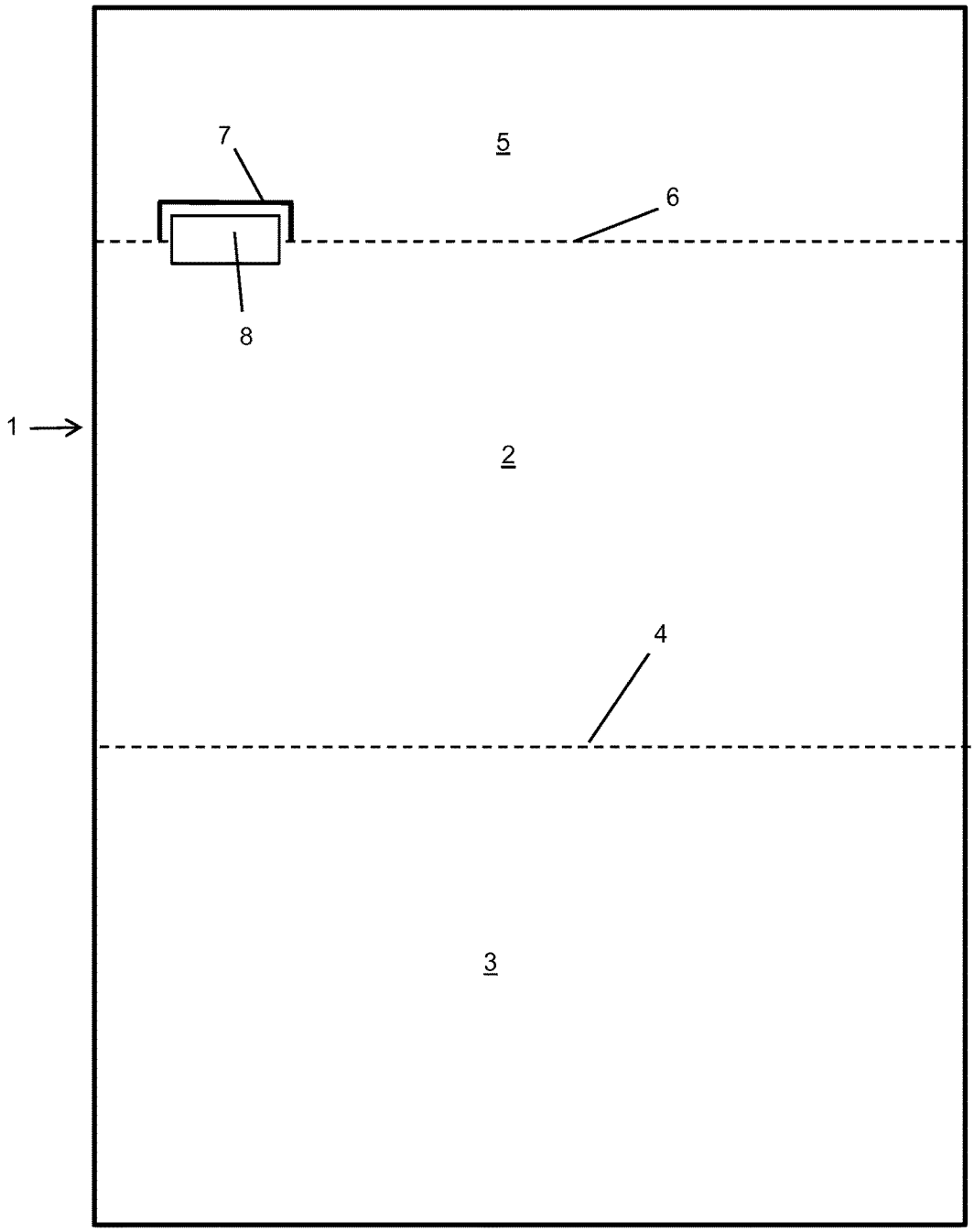
FIG. 1 is a view of a sheet to form a pouch, with label apparatus in accordance with the invention.

FIG. 1 illustrates a foldable sheet 1 of plastics material such as semi-rigid polypropylene. This defines a rear member 2, joined to a front member 3 by a fold line 4 and to a closure flap 5 by a fold line 6. A cut line 7 defines a tab area in the closure flap 5. A rectangular aperture 8 is provided, defining an open window through the sheet 1, in the region defined by the cut line 7 and by the adjoining region of the rear member 2.

Figure 4:
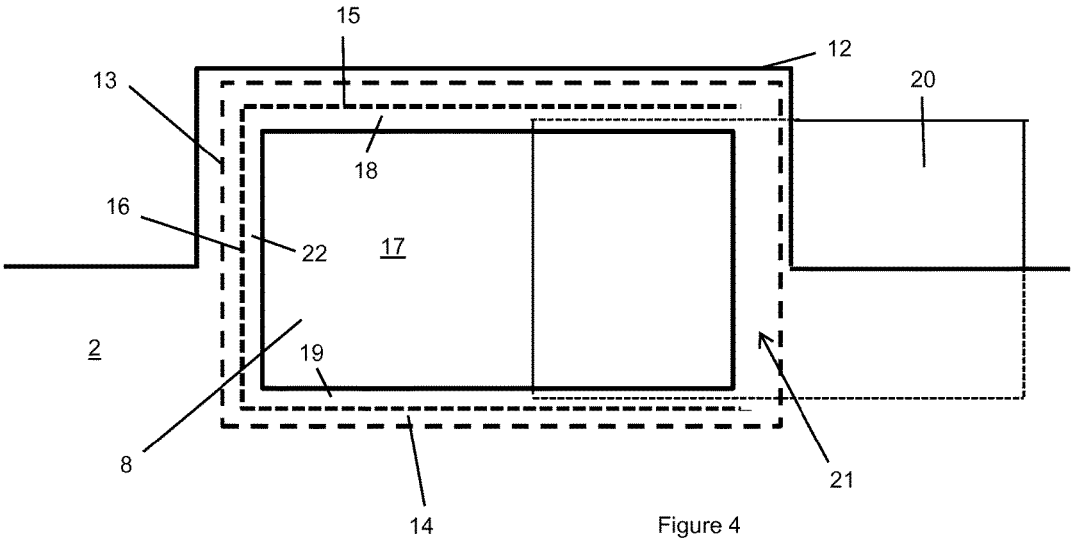
FIG. 4 is a detailed view of the label assembly.

FIG. 2 shows the front member 3 folded over the rear member 3 to form a pouch 9 with an open top, the front and rear members being joined along the lines 10 and 11 adjacent the edges of the members. This can be achieved by heat sealing, for example. FIG. 4 shows the pouch 9 with the closure flap 5 folded down over the front member 3. This provides a tab 12 projecting up from the top of the rear member 2.

FIG. 4 is an enlarged view of the tab 12 and the adjoining part of the rear member 2, illustrating the label assembly. This comprises the open window and a rectangular covering sheet 13 of flexible plastics material such as polypropylene at the back of the tab 12 and the rear member 2, behind the open window 8. The covering sheet 13 is attached to the rear member along a lower line 14, and is attached to the tab along an upper line 15. It is also attached to the rear member and the tab along a left side line 16. Attachment may be achieved by heat sealing. The covering sheet defines a writing area 17 which acts like a whiteboard having a glossy finish and can be accessed through the open window 8. The covering sheet provides a white background for the writing area 17.

Figure 5:
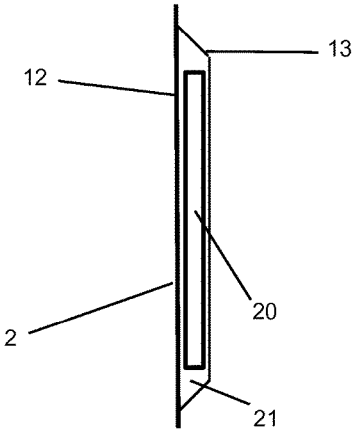
FIG. 5 is an end view of the label assembly.

The line upper 15 is spaced from the upper edge of the window 8, so that an upper channel 18 is defined. The lower line 14 is spaced from the lower edge of window 8 so that a lower channel 19 is defined. A flexible label card 20 is inserted through an opening 21 at the right side of the label apparatus, and is pushed into the channels 18 and 19 so that it is located between the material of the tab and the front member, and the material of the covering sheet 13. In this embodiment there is also a channel 22 defined at the left side of the apparatus between the line 16 and the left side of the window 8. The label card can be pushed fully in so that its end projects into this left channel 22. FIG. 5 is an end view showing the label card inserted into the label assembly through the opening 21.

The label apparatus in accordance with the invention has many advantages. In all filing systems it is preferable that the label areas all look the same. People like to see uniformity in labelling and the size of the labelling area always remains constant. This is achieved if using the present invention.

When using adhesive labels, because the labels are placed by hand it is not that easy to ensure that every label, on every file, is perfectly level and is in exactly the same position as all of the other labels. Uniformity is easily lost. The present invention assists a user to achieve this because there is a rectangular window within which an adhesive label can be placed.

In addition, just as people prefer to see pictures in a frame it is also true that in filing systems people prefer to see the label area framed. For this reason many labelling systems simply print a thin line around the outer edge of the paper label to create the "famed" look. With the system of the present invention this framed look is automatically achieved. This can be assisted if there is a contrast between the colour of the pouch, which can be dark, and the colour of the writing area. A contrast between the dark outer frame of the pouch and the whiteboard automatically creates the framed look. In addition because the label is slightly recessed, it further enhances the framed look.

Many labelling systems use thick plastic tabs into which a label slides. The problem is that when a number of these folders are grouped together the combined thickness of each plastic label holder causes the folders to fan out on one side. Preferred embodiments of the invention do not have this problem. A pouch or wallet incorporating the invention can be very thin—the only additional thickness is that of the covering sheet behind the window and, if used, a label card which is inserted.

The invention can be viewed from a number of other aspects. Thus, viewed from another aspect the invention provides label apparatus for an object, comprising a first element and a second element; wherein the first element defines an open window with a periphery having opposed first and second sides interconnected by opposed third and fourth sides; the second element is secured to the first element behind the window, the second element extending beyond the first and second sides of the window periphery and being secured to the first element at portions spaced from the first and second sides of the window periphery, the first element and the second element thus defining opposed first and second channel portions extending respectively from adjacent the first and second sides of the window periphery; and at the third side of the window periphery, the second element is not secured to the first element and the channel portions have open ends, so that a label member can be inserted behind the window between the first element and the second element, and retained in the first and second channel portions; wherein the second element has a writing surface facing the window so that, if a label member is not retained, markings can be written directly on the writing surface by means of a writing implement which extends through the window, or a label can be positioned on the writing surface through the window. Viewed from a further aspect there is provided a storage device having a first member and a second member between which is provided a storage space, the storage device having a top, a bottom and two sides, wherein adjacent the top of the device, there is provided label apparatus as described immediately above. The first element could be provided by a portion of a substrate, such as a tab of a folder, in which is provided a cut out region defining the window. The second element is then secured to the back of the portion of the substrate, behind the window. Alternatively, the first element could be in the form of a window frame. In one embodiment of such an arrangement the window frame could be secured to a portion of a substrate and the portion of the substrate could serve as the second element. In another embodiment of this type of arrangement, the window frame could first be secured to a separate second element, and the complete assembly could then be secured to a portion of a substrate.

Viewed from another aspect there is provided a storage device having a first member and a second member between which is provided a storage space, the storage device having a top, a bottom and two sides, wherein adjacent the top of the device, there is label apparatus which comprising a first element and a second element; wherein the first element of the label apparatus is provided with a cut out region which defines an open window with a periphery having opposed first and second sides interconnected by opposed third and fourth sides; and the second element is positioned behind the window and extends beyond the first and second sides of the window periphery, the first element and the second element defining opposed first and second channel portions extending respectively from adjacent the first and second sides of the window periphery; and at the third side of the window periphery, the second element is not secured to the first element and the channel portions have open ends, so that a label member can be inserted behind the window between the first element and the second element, and retained in the first and second channel portions; characterised in that the second element of the label apparatus provides a surface facing the window which is adapted as a writing surface on which markings can be written directly on the writing surface by means of a writing implement which extends through the window, and on which markings can be erased;

the second element being of flexible plastics material which acts as a whiteboard and which is separate from the material of the first and second members of the storage device and from the material of the first element of the label apparatus, the second element being secured to the first element at portions spaced from the first and second sides of the window periphery; wherein the arrangement is such that, alternatively, a label can be positioned on the writing surface through the window.

Viewed from another aspect there is provided a storage device having a first member and a second member between which is provided a storage space, the storage device having a top, a bottom and two sides, wherein adjacent the top of the device, there is label apparatus which comprising a first element and a second element; wherein the first element of the label apparatus is provided with a cut out region which defines an open window with a periphery having opposed first and second sides interconnected by opposed third and fourth sides; and the second element is positioned behind the window and extends beyond the first and second sides of the window periphery, the first element and the second element defining opposed first and second channel portions extending respectively from adjacent the first and second sides of the window periphery; and at the third side of the window periphery, the second element is not secured to the first element and the channel portions have open ends, so that a label member can be inserted behind the window between the first element and the second element, and retained in the first and second channel portions; characterised in that the second element of the label apparatus provides a surface facing the window which is adapted as a writing surface on which markings can be written directly on the writing surface by means of a writing implement which extends through the window, and on which markings can be erased; the second element being of flexible plastics material which acts as a whiteboard and which is separate from the material of the first and second members of the storage device and from the material of the first element of the label apparatus, the second element being secured to the first element at portions spaced from the first and second sides of the window periphery; wherein the arrangement is such that, alternatively, a label can be positioned on the writing surface through the window.

Viewed from another aspect, the invention provides a storage device having a first member and a second member between which is provided a storage space, the storage device having a top, a bottom and two sides, wherein adjacent the top of the first member there is an upwardly projecting integral portion of the first member which forms a first element of a label tag; the first element of the label tag being provided with a cut out region which defines an open window with a periphery having opposed first and second sides interconnected by opposed third and fourth sides; and a second element of the label tag, which is of material separate from the first element of the label tag, is positioned behind the window in the first element of the first element of the label tag and is secured to the first element of the label tag, the second element extending beyond the first and second sides of the window periphery, the first element and the second element of the label tag defining opposed first and second channel portions extending respectively from adjacent the first and second sides of the window periphery; and at the third side of the window periphery, the second element is not secured to the first element and the channel portions have open ends, so that a label member can be inserted behind the window between the first element and the second element, and retained in the first and second channel portions; wherein the second element of the label tag provides a surface facing the window which is adapted as a writing surface on which, if a label member is not present, markings can be written by means of a writing implement which extends through the window and from which markings can be erased.

Viewed from another aspect the invention provides a storage device having a first member and a second member between which is provided a storage space, the storage device having a top and a bottom, wherein projecting from the top of the first member of the storage device there is a label tag defined by a front element and a rear element, the front element being provided with an open window; the front and rear elements defining a pocket which can receive a label to be viewed through the window; characterised in that the front element of the label tag comprises an upwardly projecting extension from the top of the first member of the storage device, which is integral with the first member of the storage device, and the rear element of the label tag is a piece of material which is separate from the first and second members of the storage device and is secured to the front element of the label tag behind the window, the rear element providing a writing surface facing the window on which markings can be written by means of a writing implement which extends through the open window, the writing surface being such as to assist in dry-erase performance.

Viewed from another aspect the invention provides a storage device having a first member and a second member between which is provided a storage space, the storage device having a top and a bottom, wherein projecting from the top of the first member of the storage device there is a label tag defined by a front element and a rear element, the front element being provided with an open window; the front and rear elements defining a pocket which can receive a label to be viewed through the window; characterised in that the front element of the label tag comprises an upwardly projecting extension from the top of the first member of the storage device, which is integral with the first member of the storage device, and the rear element of the label tag is a piece of material which is separate from the first and second members of the storage device and is secured to the front element of the label tag behind the window, the rear element providing a writing surface facing the window on which markings can be written by means of a writing implement which extends through the open window, the writing surface being of a contrasting colour to the colour of the front element of the label tab. Preferably, the writing surface is of a light colour as compared to the colour of the front element of the label tab. Preferably the writing surface is such as to assist in dry-erase performance.

It will be appreciated that all of the detailed and optional features which are set out in the introduction in relation to the first aspect of the invention apply also to these additional aspects of the invention.

Thus, in certain embodiments of the invention there is provided a storage device (1) having a first member (2) and a second member (3) between which is a storage space. Adjacent the top of the first member (2) there is an upwardly projecting integral portion of the first member which forms a first element (12) of a label tag. The first element of the label tag is provided with an open window (8). Behind the window (8) is a separate cover sheet (13), which is secured to the first element (12) of the label tag so that a label member (20) can be inserted and retained behind the window (8). The cover sheet (13) provides a writing surface (17) facing the window (8) and in the absence of a label member (20) this can be written by means of a writing implement which extends through the window (8). The writing surface (17) acts as a whiteboard and may have enhanced erase performance, as compared to the first and second members of the storage device and the first element of the label tag, for example by having a glossy finish.

The invention claimed is:

1. A storage device comprising a first member and a second member between which is provided a storage space, the storage device comprising a top and a bottom, wherein a label tag being defined by a front element and a rear element projects from a top of the first member, the front element being provided with an open window; the front and rear elements defining a pocket configured to receive a label to be viewed through the open window; wherein the front element of the label tag comprises an extension that projects upwardly from the top of the first member and that is integral with the first member, and the rear element of the label tag comprises a piece of material which is separate from the first and second members and is secured to the front element of the label tag behind the open window, the rear element providing a whiteboard writing surface facing the open window, wherein the whiteboard writing surface is configured to receive markings deposited by a writing implement when at least a portion of the writing implement extends through the open window.

2. The storage device as claimed in claim 1, wherein the whiteboard writing surface of the rear element of the label tag is configured to assist in erase performance.

3. The storage device as claimed in claim 1, wherein the front element of the label tag is defined partly by the extension that projects upwardly from the top of the first member, and partly by an adjoining part of the first member.

4. The storage device as claimed in claim 3, wherein the open window is provided partly in the extension that projects upwardly from the top of the first member, and partly in the adjoining part of the first member.

5. The storage device as claimed in claim 1, wherein the rear element of the label tag is attached to a back of the extension that projects upwardly from the top of the first member, and to an adjoining part of the first member.

6. The storage device as claimed in claim 1, wherein at least portions of the first and second members comprise a rigid or semi-rigid material, and the rear element of the label tag comprises a material that is more flexible than the rigid or semi-rigid material of the at least portions of the first and second members.

7. The storage device as claimed in claim 6, wherein the rear element of the label tag comprises a flexible plastic film.

8. The storage device as claimed in claim 7, wherein the rear element of the label tag comprises polypropylene and the whiteboard writing surface is provided with a glossy finish.

9. The storage device as claimed in claim 1, in the form of a pouch manufactured from a strip of plastic material which is folded to provide the first and second members and a closure flap, the first and second members being joined along edges thereof, the closure flap being defined by the extension that projects upwardly from the top of the first member, and the front element of the label tag being at least partially defined by a cut line in the closure flap that defines a tab extending away from the top of the first member.

10. The storage device as claimed in claim 1, wherein first and second parallel channel portions are defined on opposite sides of the open window, to receive edges of a label upon insertion of the label into the pocket.

11. A storage device comprising a first member and a second member between which is provided a storage space, the storage device comprising a top, a bottom, and two sides, wherein, adjacent a top of the first member, an upwardly projecting integral portion of the first member forms a first element of a label tag; the first element of the label tag being provided with a cut out region which defines an open window with a window periphery having opposed first and second sides interconnected by opposed third and fourth sides; and a second element of the label tag, which comprises material separate from the first element of the label tag, is positioned behind the open window defined in the first element of the label tag and is secured to the first element of the label tag, the second element extending beyond the first and second sides of the window periphery, the first element and the second element of the label tag defining opposed first and second channel portions extending from adjacent the first and second sides of the window periphery, respectively; and at the third side of the window periphery, the second element is not secured to the first element and the first and second channel portions have open ends, so that a label can be inserted behind the open window between the first element and the second element, and be retained in the first and second channel portions; wherein the second element of the label tag provides a whiteboard writing surface that faces the open window and that, if the label is not present, is configured to receive markings deposited by a writing implement when at least a portion of the writing implement extends through the open window.

* * * * *